US011673229B2

(12) United States Patent
Sakai

(10) Patent No.: US 11,673,229 B2
(45) Date of Patent: Jun. 13, 2023

(54) PROCESSING APPARATUS

(71) Applicant: DISCO CORPORATION, Tokyo (JP)

(72) Inventor: Toshiyuki Sakai, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 253 days.

(21) Appl. No.: 17/010,343

(22) Filed: Sep. 2, 2020

(65) Prior Publication Data

US 2021/0069859 A1 Mar. 11, 2021

(30) Foreign Application Priority Data

Sep. 9, 2019 (JP) ..... JP2019-163637

(51) Int. Cl.

| | |
|---|---|
| ***B24B 49/12*** | (2006.01) |
| ***B24B 7/22*** | (2006.01) |
| ***B24B 37/24*** | (2012.01) |
| ***B24B 37/10*** | (2012.01) |

(52) U.S. Cl.

CPC ..... *B24B 49/12* (2013.01); *B24B 7/228* (2013.01); *B24B 37/10* (2013.01); *B24B 37/245* (2013.01)

(58) Field of Classification Search

CPC ..... B24B 49/12; B24B 7/228; B24B 7/20; B24B 7/22; B24B 37/10; B24B 37/245; B24B 37/005; B24B 37/013; B24B 37/04; B24B 37/042; B24B 37/046; B24B 37/07; B24B 37/105; B24B 37/107; B24B 37/30; B24B 37/34; H01L 21/67092; H01L 21/67288; H01L 22/12

USPC ..... 451/6

See application file for complete search history.

(56) References Cited

U.S. PATENT DOCUMENTS

| | | | | |
|---|---|---|---|---|
| 6,146,911 | A * | 11/2000 | Tsuchiya | H01L 22/12 257/E21.53 |
| 2012/0196033 | A1* | 8/2012 | Sakai | B24B 37/28 427/128 |
| 2014/0256068 | A1* | 9/2014 | Franklin | B23K 26/382 438/16 |
| 2017/0338158 | A1* | 11/2017 | Sukegawa | H01L 29/34 |
| 2017/0370856 | A1* | 12/2017 | Takeda | G01N 21/3563 |
| 2018/0099377 | A1* | 4/2018 | Sekiya | H01L 21/67092 |
| 2020/0130124 | A1* | 4/2020 | Tamura | H01L 21/304 |
| 2020/0217805 | A1* | 7/2020 | Sugiura | G01N 21/8806 |

FOREIGN PATENT DOCUMENTS

JP 2007242902 A 9/2007

* cited by examiner

*Primary Examiner* — Joel D Crandall
*Assistant Examiner* — Michael A Gump
(74) *Attorney, Agent, or Firm* — Greer Burns & Crain, Ltd.

(57) ABSTRACT

There is provided a processing apparatus that polishes the back surface side of a wafer on which devices are formed on the front surface side. The processing apparatus includes a chuck table that holds the wafer and rotates and a polishing unit that forms scratches on the back surface side of the wafer while polishing the back surface side of the wafer. The processing apparatus includes also a scratch determining unit that determines whether or not the scratches exist on the back surface side of the wafer polished by the polishing unit and an informing unit that informs that a region in which the scratches do not exist is included in the wafer when a region for which it has been determined that the scratches do not exist by the scratch determining unit is included in the wafer.

8 Claims, 7 Drawing Sheets

PROCESSING APPARATUS

BACKGROUND OF THE INVENTION

Field of the Invention

The present invention relates to a processing apparatus that polishes a wafer on which devices are formed.

Description of the Related Art

In a manufacturing process of device chips, a wafer is used on which a device such as an integrated circuit (IC) or a large scale integration (LSI) is formed on the front surface side of each of plural regions marked out by plural planned dividing lines (streets) arranged in a lattice manner. Plural device chips each including the device are obtained by dividing the wafer along the planned dividing lines. The device chips are mounted in various pieces of electronic equipment typified by mobile phones and personal computers.

Furthermore, in recent years, in association with reduction in the size and thickness of the electronic equipment, the device chips have also been required to have reduced thickness. Thus, a method of thinning a wafer by executing grinding processing and polishing processing for the back surface side of the wafer before dividing is used. For the thinning of the wafer, for example, processing apparatus including a chuck table that holds the wafer by a holding surface, a grinding unit on which a grinding wheel that grinds the wafer is mounted, and a polishing unit on which a polishing pad that polishes the wafer is mounted is used.

Furthermore, it has been confirmed that, when minute scratches exist on the back surface side of the above-described wafer, the gettering effect by which metallic elements (copper and so forth) existing inside the wafer are captured by the back surface side of the wafer is obtained. For this reason, by leaving minute scratches on the back surface side of the wafer after the grinding processing and the polishing processing, the metallic elements become less likely to move to the front surface side of the wafer, on which devices are formed, and the occurrence of operation failure (current leakage and so forth) attributed to the metallic elements is suppressed. In Japanese Patent Laid-open No. 2007-242902, a processing method is disclosed in which a region including minute scratches (gettering layer) is formed on the back surface side of a wafer by pressing a polishing tool (polishing pad) including abrasive grains against the back surface side of the wafer while rotating the polishing tool when the back surface side of the wafer is polished. When this method is used, the gettering effect can be given to the wafer without affecting the strength of the wafer.

SUMMARY OF THE INVENTION

As described above, by executing polishing processing for the back surface side of a wafer, minute scratches are formed on the back surface side of the wafer and the gettering effect is obtained. However, in some cases, the polishing pad does not properly get contact with the wafer at the time of the polishing processing, and scratches are not formed in part of the back surface side of the wafer. For example, in the case in which the holding surface of the chuck table or the polishing pad slightly tilts and the wafer and the polishing surface of the polishing pad are not disposed in parallel, the case in which there is variation in the thickness of the wafer, or the like, excess or deficiency of the load applied to the wafer at the time of the polishing processing occurs and a region in which scratches have not been formed remains on the back surface side of the wafer in some cases. In the region in which scratches have not been formed, the gettering effect does not occur, and metallic elements are not captured by the back surface side of the wafer. Thus, metallic elements easily move to the front surface side of the wafer in this region, and operation failure of the device becomes more likely to occur.

Thus, after the polishing processing of the wafer, an operator observes the whole of the back surface side of the wafer and checks whether or not scratches have been formed on the back surface side of the wafer as intended. Then, when a region in which scratches have not been formed exists, adjustment of the condition of the polishing processing and so forth are executed so that scratches may be properly formed in the whole of the back surface side of the wafer. However, work of checking whether or not minute scratches exist over the whole of the back surface side of the wafer takes enormous labor and time. Furthermore, it is difficult to check whether or not minute scratches exist, and a region in which scratches have not been formed is overlooked in some cases.

The present invention is made in view of such problems. It is therefore an object of the present invention to provide a processing apparatus with which whether or not minute scratches have been properly formed on a wafer can be checked easily and surely.

In accordance with an aspect of the present invention, there is provided a processing apparatus that polishes a back surface side of a wafer on which devices are formed on a front surface side. The processing apparatus includes a chuck table that holds the wafer and rotates and a polishing unit that forms scratches on the back surface side of the wafer while polishing the back surface side of the wafer by pressing a polishing pad containing abrasive grains against the back surface side of the wafer held by the chuck table while rotating the polishing pad. The processing apparatus includes also a scratch determining unit that determines whether or not the scratches exist on the back surface side of the wafer polished by the polishing unit and an informing unit that informs that a region in which the scratches do not exist is included in the wafer when a region for which it has been determined that the scratches do not exist by the scratch determining unit is included in the wafer.

Preferably, the scratch determining unit includes a camera that images the wafer and obtains an image of the back surface side of the wafer, and the scratch determining unit determines whether or not the scratches exist based on a difference in contrasting density between a region in which the scratches exist and a region in which the scratches do not exist, generated in the image due to irregular reflection of light in the region in which the scratches exist. Furthermore, preferably, the scratch determining unit determines whether or not the scratches exist regarding the whole of the back surface side of the wafer. Moreover, preferably, the processing apparatus further includes a grinding unit that grinds the back surface side of the wafer held by the chuck table and thins the wafer to a predetermined thickness.

The processing apparatus according to the aspect of the present invention includes the scratch determining unit that determines whether or not the scratches exist on the back surface side of the wafer and the informing unit that informs that a region in which the scratches do not exist is included in the wafer when a region for which it has been determined that the scratches do not exist by the scratch determining unit is included in the wafer. This allows the operator to easily and surely check whether or not the minute scratches have been properly formed in the wafer without executing work of visually checking the back surface side of the wafer, or the like.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
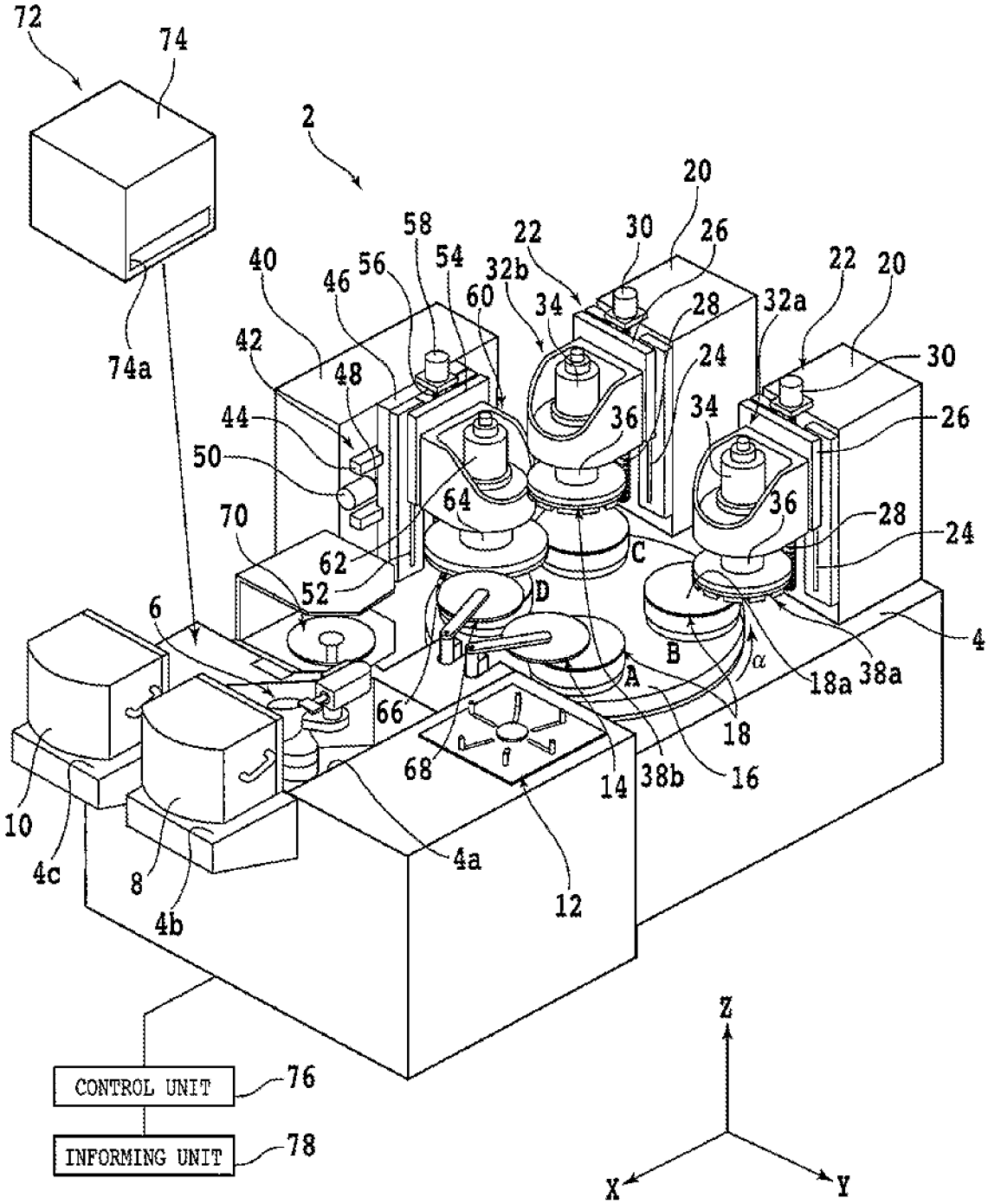
FIG. 1 is a perspective view illustrating a processing apparatus.

An embodiment of the present invention will be described below with reference to the accompanying drawings. First, a configuration example of a processing apparatus according to the present embodiment will be described. FIG. 1 is a perspective view illustrating a processing apparatus 2. The processing apparatus 2 executes grinding processing and polishing processing for a workpiece such as a silicon wafer. That is, the processing apparatus 2 functions as a grinding apparatus and a polishing apparatus.

The processing apparatus (grinding apparatus, polishing apparatus) 2 includes a base 4 that supports the respective constituent elements that configure the processing apparatus 2. An opening 4*a* is formed in the upper surface of the forward end side of the base 4 and a conveying unit (conveying mechanism) 6 is disposed inside the opening 4*a*. Furthermore, in a region on the forward side of the opening 4*a*, a cassette placement pedestal 4*b* on which a cassette 8 is placed and a cassette placement pedestal 4*c* on which a cassette 10 is placed are disposed. For example, plural workpieces before processing are housed in the cassette 8 and plural workpieces after processing are housed in the cassette 10.

Figure 2:
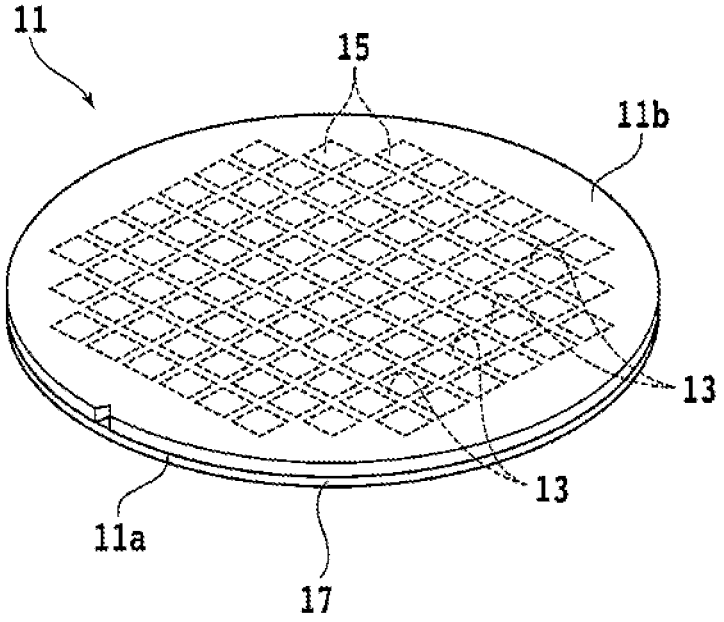
FIG. 2 is a perspective view illustrating a wafer.

FIG. 2 is a perspective view illustrating a wafer 11 that is one example of the workpiece. For example, the wafer 11 is a silicon wafer formed into a circular disc shape and has a front surface 11*a* and a back surface 11*b*. Furthermore, the wafer 11 is segmented into plural rectangular regions by plural planned dividing lines (streets) 13 arranged in a lattice manner to intersect each other, and a device 15 such an IC or an LSI is formed on the side of the front surface 11*a* of each of these regions. Plural device chips each including the device are manufactured by dividing the wafer 11 along the planned dividing lines 13. Moreover, by the processing apparatus 2 illustrated in FIG. 1, grinding processing and polishing processing are executed for the side of the back surface 11*b* of the wafer 11 before dividing and the wafer 11 is thinned. Thereby, the device chips with reduced thickness are obtained. There is no limit on the material, size, shape, structure, and so forth of the wafer 11. For example, the wafer 11 may be a wafer composed of a material such as a semiconductor other than silicon (GaAs, InP, GaN, SiC, or the like), glass, ceramic, resin, or metal. In addition, there is no limit also on the kind, quantity, shape, structure, size, arrangement, and so forth of the devices 15.

A protective component 17 that protects the side of the front surface 11*a* of the wafer 11 and the plural devices 15 is stuck to the side of the front surface 11*a* of the wafer 11. For example, the protective component 17 formed into a circular shape with a diameter equivalent to that of the wafer 11 is stuck to cover the whole of the side of the front surface 11*a* of the wafer 11. As the protective component 17, a protective tape composed of a flexible resin is used, for example. Specifically, the protective component 17 includes a circular base and an adhesion layer (glue layer) disposed on the base. The base is composed of a resin such as polyolefin, polyvinyl chloride, or polyethylene terephthalate, and the adhesion layer is composed of an epoxy-based, acrylic, or rubber-based adhesive or the like. Furthermore, it is also possible to use an ultraviolet-curable resin cured by irradiation with ultraviolet rays for the adhesion layer. However, there is no limit on the material of the protective component 17 as long as the protective component 17 can protect the side of the front surface 11*a* of the wafer 11 and the plural devices 15. For example, the protective component 17 may be a substrate with high rigidity that is composed of silicon, glass, ceramic, or the like and is formed into a plate shape.

The wafer 11 to which the protective component 17 is stuck is housed in the cassette 8 illustrated in FIG. 1 and the cassette 8 in which plural wafers 11 are housed is placed on the cassette placement pedestal 4*b*. Then, the conveying unit 6 withdraws one wafer 11 from the cassette 8 and conveys the wafer 11. A position adjustment mechanism (alignment mechanism) 12 is disposed on an oblique rear side of the opening 4*a*. The wafer 11 housed in the cassette 8 is conveyed to the position adjustment mechanism 12 by the conveying unit 6. Then, the position adjustment mechanism 12 disposes the wafer 11 in matching with a predetermined position. A conveying unit (conveying mechanism, loading arm) 14 that turnably conveys the wafer 11 with the wafer 11 held thereon and pivots is disposed at a position adjacent to the position adjustment mechanism 12. The conveying unit 14 includes a suction adhesion pad that causes suction adhesion of the upper surface side of the wafer 11 and holds the wafer 11 for which position adjustment has been executed by the position adjustment mechanism 12 through suction adhesion by the suction adhesion pad and conveys the wafer 11 rearward.

A turntable 16 with a circular disc shape is disposed on the rear side of the conveying unit 14. The turntable 16 is coupled to a rotational drive source (not illustrated) such as a motor and rotates around a rotation axis substantially parallel to a Z-axis direction (vertical direction, upward-downward direction). Furthermore, on the turntable 16, plural chuck tables (holding tables) 18 (in FIG. 4, four tables) that hold the wafer 11 are disposed at substantially equal intervals along the circumferential direction of the turntable 16.

The upper surface of the chuck table 18 forms a holding surface 18*a* that holds the wafer 11. For example, the holding surface 18*a* is formed into a circular shape with a larger diameter than the wafer 11. However, the shape of the holding surface 18*a* is not limited and is set as appropriate according to the shape of the wafer 11. Furthermore, the holding surface 18*a* is connected to a suction source (not illustrated) such as an ejector through a flow path (not illustrated) formed inside the chuck table 18. There is no limit on the kind and structure of the chuck table that holds the wafer 11. For example, chuck tables that hold the wafer 11 by a mechanical method, electrical method, or the like may be used instead of the chuck tables 18. The chuck tables 18 are each coupled to a rotational drive source (not illustrated) such as a motor and each rotate around a rotation axis substantially parallel to the Z-axis direction.

Furthermore, the turntable 16 rotates in an anticlockwise manner (in a direction illustrated by an arrow a) in plan view and positions each chuck table 18 to a conveyance position A, a coarse grinding position B, a finishing grinding position C, a polishing position D, and the conveyance position A in that order. Moreover, the conveying unit 14 conveys the wafer 11 disposed on the position adjustment mechanism 12 onto the chuck table 18 positioned at the conveyance position A.

A column-shaped support structure 20 is disposed on each of the rear side of the coarse grinding position B and the rear side of the finishing grinding position C (on the rear side of the turntable 16). Z-axis movement mechanisms 22 are disposed on the forward surface side of the support structures 20. The Z-axis movement mechanism 22 includes a pair of Z-axis guide rails 24 disposed in substantially parallel to the Z-axis direction and a plate-shaped Z-axis moving plate 26 is mounted on the pair of Z-axis guide rails 24 in the state of being slidable along the Z-axis guide rails 24. A nut part (not illustrated) is disposed on the rear surface side (back surface side) of the Z-axis moving plate 26 and a Z-axis ball screw 28 disposed in substantially parallel to the Z-axis guide rails 24 is screwed to the nut part. Furthermore, a Z-axis pulse motor 30 is coupled to one end part of the Z-axis ball screw 28. When the Z-axis ball screw 28 is rotated by the Z-axis pulse motor 30, the Z-axis moving plate 26 moves in the Z-axis direction along the Z-axis guide rails 24.

A grinding unit 32*a* that executes coarse grinding of the wafer 11 is mounted on the forward surface side (front surface side) of the Z-axis moving plate 26 disposed on the upper side of the coarse grinding position B. Meanwhile, a grinding unit 32*b* that executes finishing grinding of the wafer 11 is mounted on the forward surface side (front surface side) of the Z-axis moving plate 26 disposed on the upper side of the finishing grinding position C. Movement of the grinding units 32*a* and 32*b* in the Z-axis direction is controlled by the Z-axis movement mechanisms 22. The grinding units 32*a* and 32*b* each include a circular cylindrical housing 34 mounted to the Z-axis moving plate 26. A spindle 36 that forms a rotation axis and has a circular cylindrical shape is housed in the housing 34 in the state of being rotatable and the lower end part (tip part) of the spindle 36 protrudes from the lower end of the housing 34.

A grinding wheel 38*a* for executing coarse grinding of the wafer 11 is mounted on the lower end part of the spindle 36 included in the grinding unit 32*a*. Furthermore, a grinding wheel 38*b* for executing finishing grinding of the wafer 11 is mounted on the lower end part of the spindle 36 included in the grinding unit 32*b*. The grinding wheels 38*a* and 38*b* each include plural grinding abrasive stones 82 (see FIG. 3) for grinding the wafer 11. A rotational drive source (not illustrated) such as a motor is connected to the upper end side (base end side) of the spindle 36 and the grinding wheels 38*a* and 38*b* rotate around the rotation axis substantially parallel to the Z-axis direction by a rotational force transmitted from the rotational drive source through the spindle 36. Moreover, grinding liquid supply paths (not illustrated) for supplying a grinding liquid such as purified water are made inside the grinding units 32*a* and 32*b*. The grinding liquid is supplied toward the wafer 11 and the grinding abrasive stones 82 when grinding processing is executed for the wafer 11.

The grinding unit 32*a* grinds the wafer 11 held by the chuck table 18 positioned at the coarse grinding position B by the grinding wheel 38*a*. Thereby, coarse grinding processing of the wafer 11 is executed. Furthermore, the grinding unit 32*b* grinds the wafer 11 held by the chuck table 18 positioned at the finishing grinding position C by the grinding wheel 38*b*. Thereby, finishing grinding processing of the wafer 11 is executed.

A column-shaped support structure 40 is disposed on a lateral side of the polishing position D (lateral side of the turntable 16). An XZ-axis movement mechanism 42 is disposed on the front surface side of the support structure 40 (on the side of the turntable 16). The XZ-axis movement mechanism 42 includes a pair of first guide rails 44 disposed in substantially parallel to the X-axis direction (forward-rearward direction) and a plate-shaped first moving plate 46 is mounted on the pair of first guide rails 44 in the state of being slidable along the first guide rails 44. A nut part (not illustrated) is disposed on the back surface side of the first moving plate 46 and a first ball screw 48 disposed in substantially parallel to the first guide rails 44 is screwed to the nut part. Furthermore, a first pulse motor 50 is coupled to one end part of the first ball screw 48. When the first ball screw 48 is rotated by the first pulse motor 50, the first moving plate 46 moves in the X-axis direction along the first guide rails 44.

A pair of second guide rails 52 disposed in substantially parallel to the Z-axis direction are disposed on the front surface side of the first moving plate 46 (on the side of the turntable 16). A plate-shaped second moving plate 54 is mounted on the pair of second guide rails 52 in the state of being slidable along the second guide rails 52. A nut part (not illustrated) is disposed on the back surface side of the second moving plate 54 and a second ball screw 56 disposed in substantially parallel to the second guide rails 52 is screwed to the nut part. A second pulse motor 58 is coupled to one end part of the second ball screw 56. When the second ball screw 56 is rotated by the second pulse motor 58, the second moving plate 54 moves in the Z-axis direction along the second guide rails 52. Furthermore, a polishing unit 60 that polishes the wafer 11 is mounted on the front surface side of the second moving plate 54 (on the side of the turntable 16). Movement of the polishing unit 60 in the X-axis direction and the Z-axis direction is controlled by the XZ-axis movement mechanism 42.

The polishing unit 60 includes a circular cylindrical housing 62 mounted to the second moving plate 54. A spindle 64 that forms a rotation axis and has a circular cylindrical shape is housed in the housing 62 in the state of being rotatable and the lower end part of the spindle 64 protrudes from the lower end of the housing 62. A circular-disc-shaped polishing pad 66 for polishing the wafer 11 is mounted on the lower end part of the spindle 64. Furthermore, a rotational drive source (not illustrated) such as a motor is connected to the upper end side (base end side) of the spindle 64. The polishing pad 66 rotates around the rotation axis substantially parallel to the Z-axis direction by a rotational force transmitted from the rotational drive source through the spindle 64. The polishing unit 60 polishes the wafer 11 held by the chuck table 18 positioned at the polishing position D by the polishing pad 66. Thereby, polishing processing of the wafer 11 is executed.

A conveying unit (conveying mechanism, unloading arm) 68 that holds the wafer 11 and pivots is disposed at a position adjacent to the conveying unit 14. The conveying unit 68 includes a suction adhesion pad that causes suction adhesion of the upper surface side of the wafer 11 and holds the wafer 11 disposed on the chuck table 18 disposed at the conveyance position A through suction adhesion by the suction adhesion pad and conveys the wafer 11 forward. Furthermore, a cleaning unit (cleaning mechanism) 70 that cleans the wafer 11 after processing by a cleaning liquid such as purified water is disposed on the forward side of the conveying unit 68.

A scratch determining unit 72 that determines whether or not scratches of the wafer 11 exist is disposed on the forward side of the cleaning unit 70. The scratch determining unit 72 images the wafer 11 polished by the polishing unit 60 and determines whether or not scratches have been formed on the surface polished by the polishing pad 66 in the wafer 11. The scratch determining unit 72 includes a casing 74 with a rectangular parallelepiped shape and the casing 74 has an opening 74*a* with such shape and size as to allow the wafer 11 to pass through the opening 74*a* in a side surface facing the side of the conveying unit 6. The wafer 11 cleaned by the cleaning unit 70 is conveyed to the inside of the casing 74 through the opening 74*a* by the conveying unit 6. Then, whether or not scratches of the wafer 11 exist is determined inside the casing 74. Details of the configuration and functions of the scratch determining unit 72 will be described later.

The wafer 11 for which whether or not scratches exist has been determined by the scratch determining unit 72 is conveyed by the conveying unit 6 and is housed in the cassette 10. That is, in the cassette 10, plural wafers 11 for which the processing has been executed by the grinding units 32*a* and 32*b* and the polishing unit 60 and whether or not scratches exist has been inspected by the scratch determining unit 72 are housed.

The respective constituent elements that configure the processing apparatus 2 (the conveying unit 6, the position adjustment mechanism 12, the conveying unit 14, the turntable 16, the chuck tables 18, the Z-axis movement mechanisms 22, the grinding units 32*a* and 32*b*, the XZ-axis movement mechanism 42, the polishing unit 60, the conveying unit 68, the cleaning unit 70, the scratch determining unit 72, and so forth) are each connected to a control unit (control part) 76. Operation of each constituent element of the processing apparatus 2 is controlled by the control unit 76. The control unit 76 is configured by a computer or the like. Specifically, the control unit 76 includes a processing section that executes processing of various kinds of arithmetic operation and so forth necessary for control of the processing apparatus 2 and a storing section in which various kinds of data, programs, and so forth used for the processing by the processing section are stored. The processing section is configured to include a processor such as a central processing unit (CPU), for example, and the storing section is configured by a memory such as a random access memory (RAM), for example. The processing section and the storing section are connected to each other through a bus.

Furthermore, an informing unit (informing part) 78 that informs predetermined information to the operator is connected to the control unit 76. For example, the informing unit 78 is configured by a warning lamp regarding which lighting is controlled by the control unit 76, a display that can display predetermined information, a speaker that issues voice or warning sound corresponding to predetermined information, and so forth. Moreover, it is also possible for the informing unit 78 to be configured by a transmitter that transmits predetermined information to equipment such as a computer separately disposed outside the processing apparatus 2 in a wired or wireless manner.

Next, a specific example of operation of the processing apparatus 2 when the wafer 11 is processed by the processing apparatus 2 will be described. At the time of processing of the wafer 11, first, plural wafers 11 before processing are housed in the cassette 8 and the cassette 8 is placed on the cassette placement pedestal 4*b*. Next, one wafer 11 housed in the cassette 8 is conveyed to the position adjustment mechanism 12 by the conveying unit 6 and position adjustment of the wafer 11 is executed by the position adjustment mechanism 12. Then, the wafer 11 for which the position adjustment has been executed is conveyed onto the chuck table 18 disposed at the conveyance position A by the conveying unit 14. The wafer 11 is disposed on the chuck table 18 in such a manner that the side of the front surface 11*a* (side of the protective component 17) is opposed to the holding surface 18*a* and the side of the back surface 11*b* is exposed upward. By causing a negative pressure of the suction source to act on the holding surface 18*a* in this state, the wafer 11 is sucked and held by the chuck table 18 with the intermediary of the protective component 17.

Figure 3:
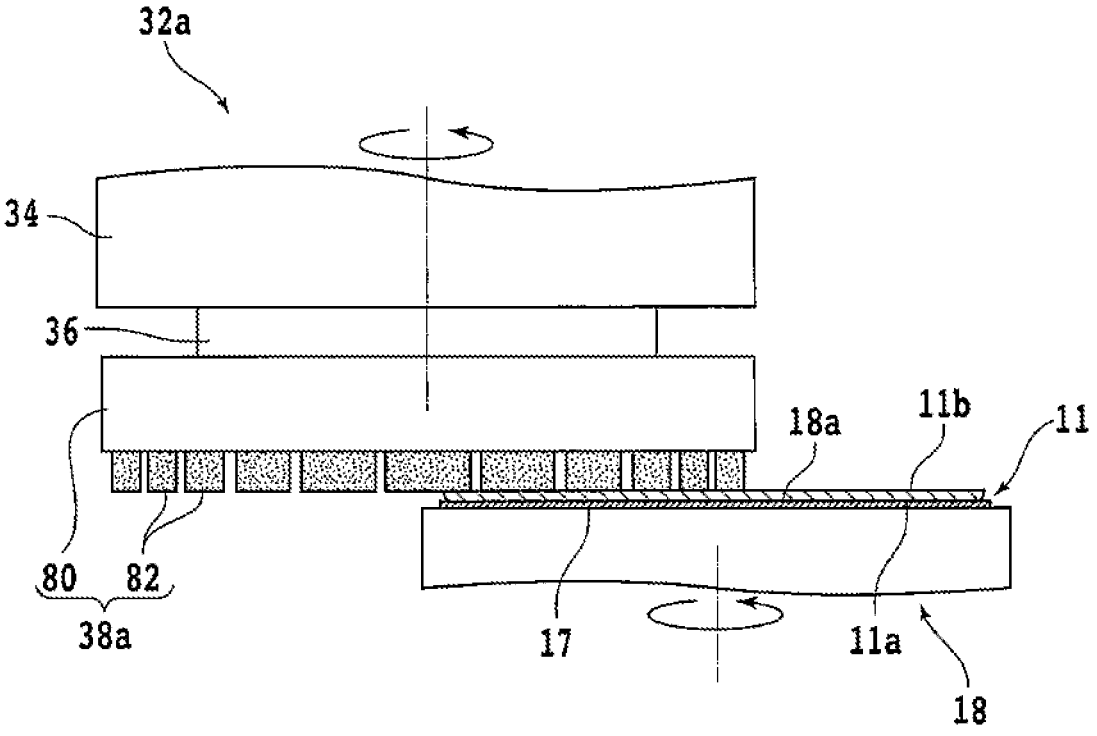
FIG. 3 is a partially sectional side view illustrating the wafer ground by a grinding unit.

Next, the turntable 16 rotates and the chuck table 18 that holds the wafer 11 is disposed at the coarse grinding position B. Then, the wafer 11 held by the chuck table 18 positioned at the coarse grinding position B is ground by the grinding unit 32*a*. FIG. 3 is a partially sectional side view illustrating the wafer 11 ground by the grinding unit 32*a*.

When the chuck table 18 is positioned at the coarse grinding position B, the wafer 11 is disposed below the grinding unit 32*a*. The grinding wheel 38*a* mounted on the grinding unit 32*a* includes a circular annular base 80 composed of a metal such as stainless steel or aluminum. Furthermore, the plural grinding abrasive stones 82 formed into a rectangular parallelepiped shape are fixed on the lower surface side of the base 80. The plural grinding abrasive stones 82 are arranged at substantially equal intervals along the outer circumference of the base 80. For example, the grinding abrasive stones 82 are formed by fixing abrasive grains composed of diamond, cubit boron nitride (cBN), or the like by a binding material such as a metal bond, resin bond, or vitrified bond. However, there is no limit on the material, shape, structure, size, and so forth of the grinding abrasive stones 82. In addition, the number of grinding abrasive stones 82 included in the grinding wheel 38*a* can be optionally set.

While the chuck table 18 and the grinding wheel 38*a* are each rotated in a predetermined direction at a predetermined rotation speed, the grinding wheel 38*a* is lowered toward the chuck table 18 by the Z-axis movement mechanism 22 (see FIG. 1). The lowering speed of the grinding wheel 38*a* at this time is adjusted to cause the plural grinding abrasive stones 82 to be pressed against the side of the back surface 11*b* of the wafer 11 with a proper force. When the lower surfaces of the plural grinding abrasive stones 82 that rotate get contact with the side of the back surface 11*b* of the wafer 11, the side of the back surface 11*b* of the wafer 11 is ground off. Thereby, grinding processing is executed for the wafer 11 and the wafer 11 becomes thinner. Then, when the wafer 11 has been thinned to a predetermined thickness, the coarse grinding of the wafer 11 is completed. When the wafer 11 is ground by the plural grinding abrasive stones 82, the grinding liquid such as purified water is supplied to the wafer 11 and the plural grinding abrasive stones 82. By the grinding liquid, the wafer 11 and the plural grinding abrasive stones 82 are cooled and dust generated due to the grinding of the wafer 11 (grinding dust) is washed off.

Next, the turntable 16 rotates and the chuck table 18 that holds the wafer 11 is disposed at the finishing grinding position C. Then, the wafer 11 held by the chuck table 18 positioned at the finishing grinding position C is ground by the grinding unit 32*b*. The configuration and operation of the grinding unit 32*b* are the same as the grinding unit 32*a* (see FIG. 3). However, the average grain size of the abrasive grains of the grinding abrasive stones included in the grinding wheel 38*b* is smaller than the average grain size of the abrasive grains of the grinding abrasive stones 82 included in the grinding wheel 38*a*. The lower surfaces of the plural grinding abrasive stones included in the grinding wheel 38*b* get contact with the side of the back surface 11*b* of the wafer 11 and thereby the side of the back surface 11*b* of the wafer 11 is ground. Then, when the wafer 11 has been thinned to a predetermined thickness, the finishing grinding of the wafer 11 is completed.

Figure 4:
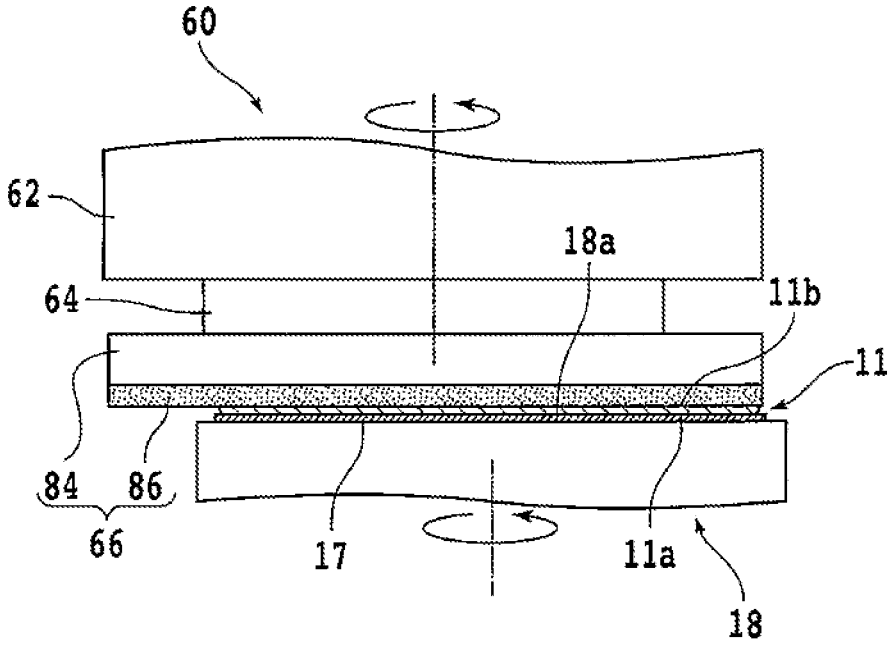
FIG. 4 is a partially sectional side view illustrating the wafer polished by a polishing unit.

Next, the turntable 16 rotates and the chuck table 18 that holds the wafer 11 is disposed at the polishing position D. Then, the wafer 11 held by the chuck table 18 positioned at the polishing position D is polished by the polishing unit 60. FIG. 4 is a partially sectional side view illustrating the wafer 11 polished by the polishing unit 60.

When the chuck table 18 is positioned at the polishing position D, the wafer 11 is disposed below the polishing unit 60. The polishing pad 66 mounted on the polishing unit 60 includes a circular-disc-shaped base 84 composed of a metal material such as stainless steel or aluminum. Furthermore, a polishing layer 86 that polishes the wafer 11 is fixed to the lower surface side of the base 84. For example, the polishing layer 86 is formed into a circular disc shape with substantially the same diameter as the base 84 and is stuck to the lower surface side of the base 84 by an adhesive or the like. The lower surface of the polishing layer 86 forms a polishing surface that polishes the wafer 11. The polishing layer 86 is formed by causing a base component formed of nonwoven cloth, urethane foam, or the like to contain abrasive grains composed of silicon oxide ($SiO_2$), green carborundum (GC), white alundum (WA), or the like. As the abrasive grains contained in the polishing layer 86, abrasive grains whose average grain size is at least 0.1 μm and at most 10 μm are used, for example. However, the material of the polishing layer 86 and the grain size and material of the abrasive grains can be changed as appropriate according to the material of the wafer 11 and so forth.

When the wafer 11 is polished, first, the polishing pad 66 is positioned in such a manner that the polishing layer 86 overlaps with the whole of the back surface 11*b* of the wafer 11. Then, while the chuck table 18 and the polishing pad 66 are each rotated in a predetermined direction at a predetermined rotation speed, the polishing pad 66 is lowered toward the chuck table 18 by the XZ-axis movement mechanism 42 (see FIG. 1). The lowering speed of the polishing pad 66 at this time is adjusted to cause the polishing layer 86 to be pressed against the side of the back surface 11*b* of the wafer 11 with a proper force. By pressing the polishing pad 66 against the side of the back surface 11*b* of the wafer 11 while rotating the polishing pad 66, the side of the back surface 11*b* of the wafer 11 is polished. Then, when the wafer 11 has been thinned to a predetermined thickness, the polishing processing of the wafer 11 is completed. By this polishing processing, processing marks (grinding marks) formed on the side of the back surface 11*b* of the wafer 11 when the wafer 11 is ground by the grinding units 32*a* and 32*b* are removed.

At the time of the polishing of the wafer 11, a liquid (polishing liquid) such as a chemical (slurry) or purified water is not supplied to the wafer 11 and the polishing pad 66. That is, the wafer 11 is processed by dry polishing using the polishing pad 66 containing the abrasive grains. However, the wafer 11 may be processed by wet polishing. In this case, the polishing liquid that does not contain abrasive grains is supplied to the wafer 11 and the polishing pad 66 at the time of the polishing of the wafer 11. As the polishing liquid, a chemical such as an acid polishing liquid or alkaline polishing liquid or purified water can be used, for example. An acid solution in which permanganate or the like is dissolved, or the like, is used as the acid polishing liquid, and an alkaline solution in which sodium hydroxide or potassium hydroxide is dissolved, or the like, is used as the alkaline polishing liquid.

Next, the turntable 16 rotates and the chuck table 18 that holds the wafer 11 is disposed at the conveyance position A. Then, the wafer 11 for which the grinding processing and the polishing processing have been executed is conveyed from the chuck table 18 positioned at the conveyance position A to the cleaning unit 70 by the conveying unit 68. Then, the wafer 11 after the processing is cleaned by the cleaning unit 70.

Figure 5A:
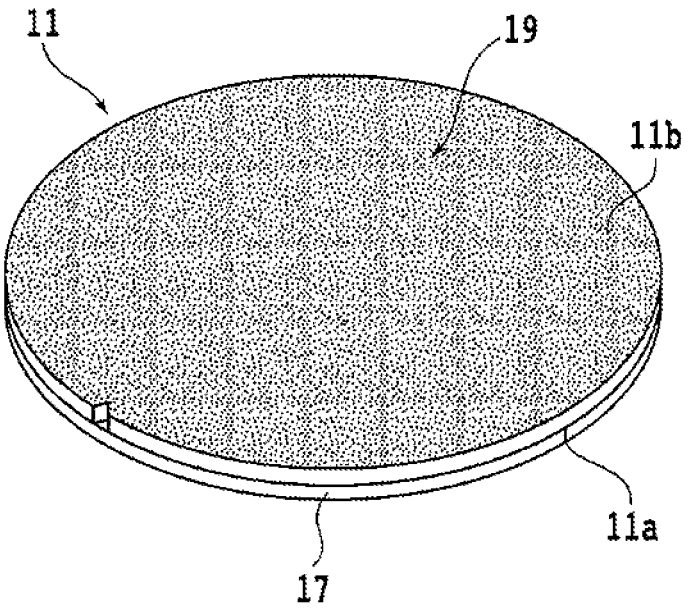
FIG. 5A is a perspective view illustrating the wafer in which scratches have been formed on the whole of the back surface side.
Figure 5B:
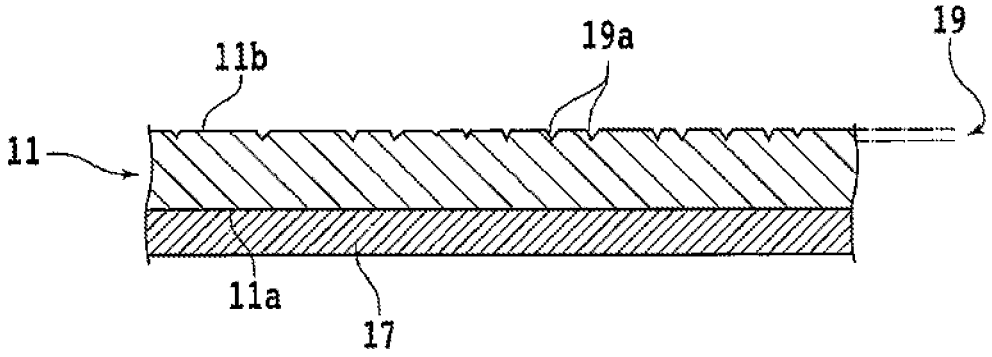
FIG. 5B is an enlarged sectional view illustrating the region in which the scratches have been formed in the wafer.

When the side of the back surface 11*b* of the wafer 11 is polished by the polishing pad 66 containing the abrasive grains as described above, a region (damage layer) in which minute scratches (polishing marks) have been formed remains on the side of the back surface 11*b* of the wafer 11. FIG. 5A is a perspective view illustrating the wafer 11 in which scratches have been formed on the whole of the side of the back surface 11*b*. FIG. 5B is an enlarged sectional view illustrating the region in which the scratches have been formed in the wafer 11. It has been confirmed that the gettering effect by which metallic elements (copper and so forth) existing inside the wafer 11 are captured by the side of the back surface 11*b* of the wafer 11 is obtained when a damage layer (gettering layer) 19 equivalent to a region in which scratches (polishing marks) 19*a* have been formed is formed on the side of the back surface 11*b* of the wafer 11. For this reason, due to forming the damage layer 19 on the side of the back surface 11*b* of the wafer 11, the metallic elements become less likely to move to the side of the front surface 11*a* of the wafer 11, on which the plural devices (see FIG. 2) are formed, and operation failure (current leakage and so forth) of the device 15 attributed to the metallic elements becomes less likely to occur.

The thickness of the damage layer 19 (depth of the scratches 19*a*) is controlled based on the condition of the polishing processing. For example, the damage layer 19 with a desired thickness can be formed by adjusting the rotation speed of the chuck table 18 and the polishing pad 66, the lowering speed of the polishing pad 66, the strength at which the polishing pad 66 is pressed against the wafer 11 (pressing force), the grain size of the abrasive grains contained in the polishing pad 66, and so forth. The thickness of the damage layer 19 formed by the polishing processing is as extremely small as 1 μm or smaller, for example, and the damage layer 19 hardly affects the strength of the wafer 11. For this reason, although device chips are manufactured through dividing the wafer 11 in which the damage layer 19 has been formed, the flexural strength (bending strength) of the device chips does not greatly lower and there is no influence on the quality of the device chips.

However, even when the wafer 11 is polished by the polishing pad 66 containing the abrasive grains, the scratches 19*a* are not formed on the side of the back surface 11*b* of the wafer 11 as intended in some cases. For example, in the case in which the holding surface 18*a* of the chuck table 18 or the polishing pad 66 slightly tilts and the wafer 11 and the polishing surface of the polishing pad 66 are not disposed in parallel, the case in which there is variation in the thickness of the wafer 11, or the like, the polishing pad 66 does not properly get contact with the wafer 11 and the scratches 19*a* are not formed in part of the side of the back surface 11*b* of the wafer 11 in some cases.

Figure 6A:
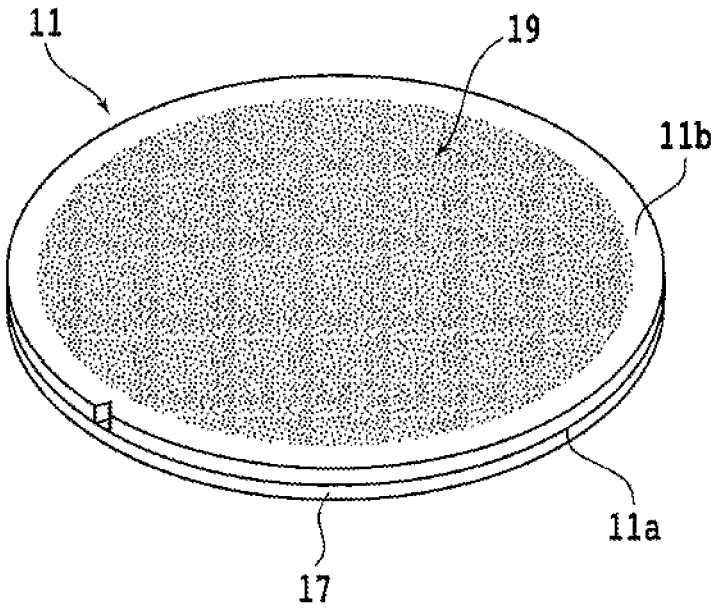
FIG. 6A is a perspective view illustrating the wafer in which scratches have not been formed in part of the back surface side.
Figure 6B:
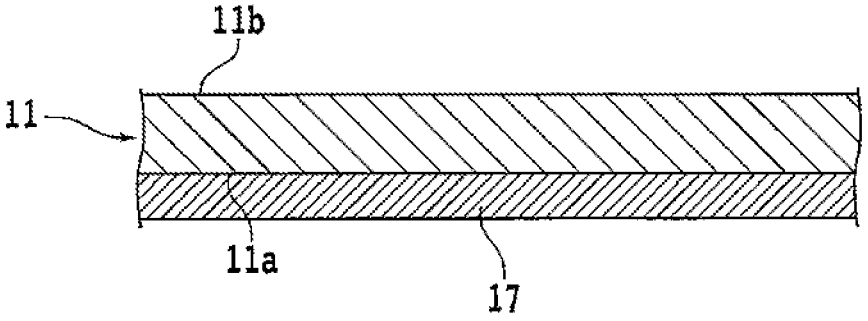
FIG. 6B is an enlarged sectional view illustrating the region in which scratches have not been formed in the wafer.

FIG. 6A is a perspective view illustrating the wafer 11 in which scratches have not been formed in part of the side of the back surface 11*b*. FIG. 6B is an enlarged sectional view illustrating the region in which scratches have not been formed in the wafer 11. For example, when the polishing layer 86 (see FIG. 4) of the polishing pad 66 is not sufficiently pressed against the peripheral part of the wafer 11, a region in which the scratches 19*a* have not been formed remains at the peripheral part of the wafer 11 as illustrated in FIG. 6A in some cases. In the region in which the scratches 19*a* have not been formed in the wafer 11, the above-described gettering effect does not occur. For this reason, the metallic elements contained inside the wafer 11 readily move to the side of the front surface 11*a* of the wafer 11 in this region and operation failure of the device 15 readily occurs. Thus, it is preferable to inspect whether or not the scratches 19*a* have been formed in the whole of the side of the back surface 11*b* of the wafer 11 as intended after the polishing processing of the wafer 11.

In the processing apparatus 2 according to the present embodiment, by the scratch determining unit 72 (see FIG. 1), the side of the back surface 11*b* of the wafer 11 is observed and whether or not the scratches 19*a* exist on the side of the back surface 11*b* of the wafer 11 is determined. Then, when a region for which it has been determined that the scratches 19*a* do not exist by the scratch determining unit 72 is included in the wafer 11, information indicating this is informed to the operator by the informing unit 78. A specific example of the configuration and functions of the scratch determining unit 72 will be described below.

Figure 7:
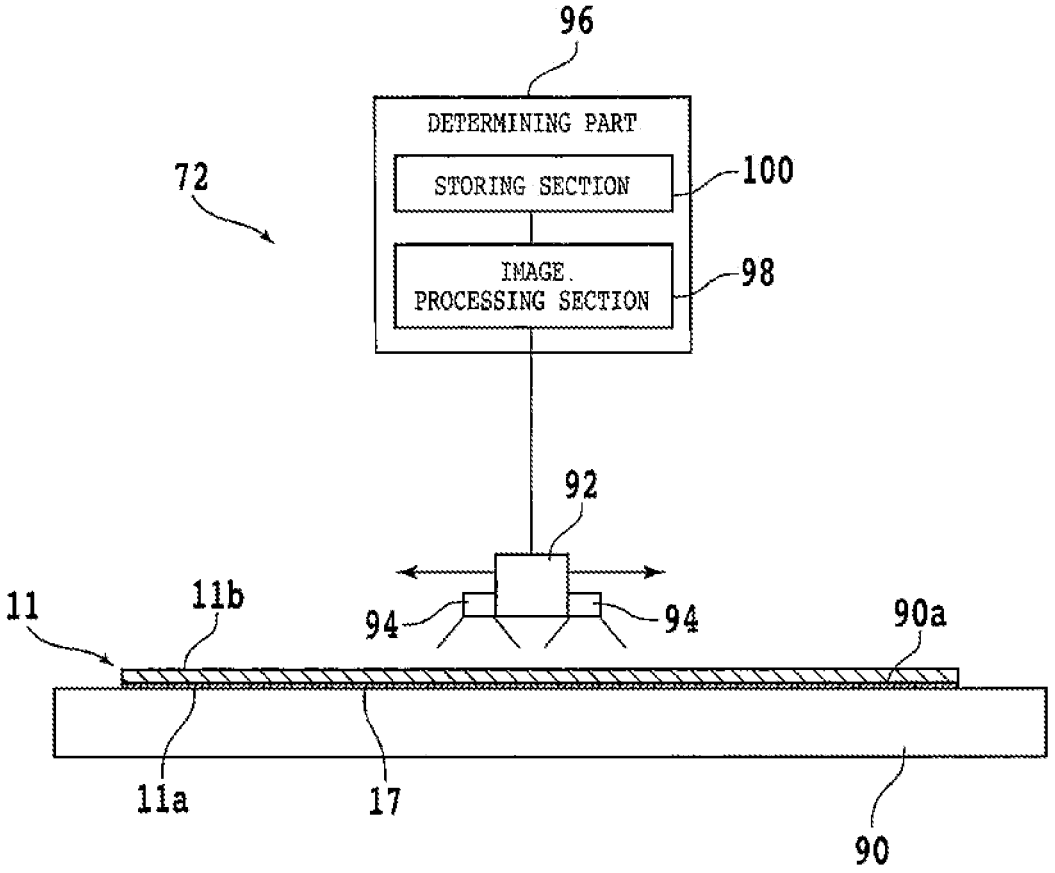
FIG. 7 is a partially sectional side view illustrating a scratch determining unit.

FIG. 7 is a partially sectional side view illustrating the scratch determining unit 72 that determines whether or not the scratches 19*a* exist. The scratch determining unit 72 includes a chuck table (holding table) 90 disposed inside the casing 74 (see FIG. 1). The chuck table 90 holds the wafer 11 conveyed from the cleaning unit 70 by the conveying unit 6 (see FIG. 1). The upper surface of the chuck table 90 forms a holding surface 90*a* that holds the wafer 11. For example, the holding surface 90*a* is formed into a circular shape with a larger diameter than the wafer 11. However, the shape of the holding surface 90*a* is not limited and is set as appropriate according to the shape of the wafer 11. Furthermore, the holding surface 90*a* is connected to a suction source (not illustrated) such as an ejector through a flow path (not illustrated) formed inside the chuck table 90.

Above the chuck table 90, a camera (imaging unit) 92 that images the wafer 11 held by the chuck table 90 is disposed. The camera 92 images the side of the back surface 11*b* of the wafer 11 and acquires an image of the side of the back surface 11*b* of the wafer 11. A pair of illuminators 94 disposed to sandwich the camera 92 are fixed to the camera 92. The illuminators 94 emit light toward the wafer 11 when the camera 92 images the wafer 11. Through controlling the brightness of these illuminators 94, the brightness of the image acquired by the camera 92 is adjusted. Furthermore, a movement mechanism (not illustrated) that moves the camera 92 in the horizontal direction (X-axis direction (forward-rearward direction) and Y-axis direction (left-right direction)) is connected to the camera 92. By moving the camera 92 by the movement mechanism, the camera 92 can be disposed at an optional position above the wafer 11.

Moreover, the camera 92 is connected to a determining part (determining unit) 96 that determines whether or not the scratches 19*a* exist based on the image (captured image) of the wafer 11 acquired by the camera 92. For example, the determining part 96 includes an image processing section 98 that executes predetermined image processing for the image acquired by the camera 92 and a storing section 100 in which various kinds of data used for the processing by the image processing section 98 are stored.

The determining part 96 is configured by the control unit 76 (see FIG. 1) of the processing apparatus 2, for example. In this case, the image processing section 98 corresponds to the processing section of the control unit 76 and the storing section 100 corresponds to the storing section of the control unit 76. However, the determining part 96 may be configured by determining equipment or the like independent of the control unit 76. In this case, the determining part 96 may be disposed outside the camera 92 or may be incorporated in the camera 92.

The wafer 11 cleaned by the cleaning unit 70 (see FIG. 1) is conveyed onto the chuck table 90 through the opening 74*a* of the casing 74 by the conveying unit 6. At this time, the wafer 11 is disposed on the chuck table 90 in such a manner that the side of the front surface 11*a* (side of the protective component 17) is opposed to the holding surface 90*a* and the side of the back surface 11*b* is exposed upward. When a negative pressure of the suction source is caused to act on the holding surface 90*a* in this state, the wafer 11 is sucked and held by the chuck table 90 with the intermediary of the protective component 17.

Next, while light is emitted from the illuminators 94 toward the wafer 11, the wafer 11 is imaged by the camera 92 and an image of the side of the back surface 11*b* of the wafer 11 is acquired. For example, the camera 92 images the whole of the back surface 11*b* of the wafer 11 at a magnification with which the scratches 19*a* formed on the side of the back surface 11*b* of the wafer 11 are displayed in the image obtained by the imaging.

The captured image obtained by the camera 92 is input to the image processing section 98 included in the determining part 96. Then, the image processing section 98 determines whether or not the scratches 19*a* have been formed on the side of the back surface 11*b* of the wafer 11 by executing predetermined image processing for the captured image. For example, in the storing section 100, an image of the side of the back surface 11*b* of the wafer 11 in which the scratches 19*a* are not formed is stored as an image for reference in advance. Furthermore, the image processing section 98 compares the captured image input from the camera 92 and the image for reference stored in the storing section 100 and calculates the degree of similarity between both (pattern matching), and determines whether or not the scratches 19*a* have been formed on the side of the back surface 11*b* of the wafer 11 based on the degree of similarity. Specifically, the degree of similarity between the captured image and the image for reference is high when the scratches 19*a* have not been formed on the side of the back surface 11*b* of the wafer 11. On the other hand, the degree of similarity between the captured image and the image for reference is low when the scratches 19*a* have been formed on the side of the back surface 11*b* of the wafer 11. Thus, for example, it can be determined whether or not the scratches 19*a* have been formed on the side of the back surface 11*b* of the wafer 11 held by the chuck table 90 based on whether or not the degree of similarity between the captured image and the image for reference exceeds a predetermined value (threshold).

However, there is no limit on the contents of the image processing by the image processing section 98 and the method for determining whether or not the scratches 19*a* exist. For example, the image processing section 98 may execute edge detection processing for a captured image input from the camera 92 and determine whether or not the scratches 19*a* exist based on whether or not edges corresponding to the scratches 19*a* are detected in the captured image.

In order to suppress the lowering of the strength of the wafer 11 as much as possible, the scratches 19*a* are formed extremely minutely in some cases. In this case, even when the whole of the side of the back surface 11*b* of the wafer 11 is imaged by one time of imaging, the scratches 19*a* are not clearly displayed in the captured image and detection of the scratches 19*a* is difficult. Thus, it is preferable to execute imaging of the wafer 11 by repeating work of magnifying part of the wafer 11 and imaging the magnified part by the camera 92 while changing the position of the camera 92 in the horizontal direction by the movement mechanism. Furthermore, by combining the plural magnified images acquired by the camera 92, a high-resolution image in which the whole of the side of the back surface 11*b* of the wafer 11 is displayed is obtained. By using this combined image for the image processing by the image processing section 98, improvement in the detection accuracy of the scratches 19*a* can be intended.

Moreover, the scratches 19*a* are extremely minute (for example, the depth is 50 nm or smaller) and it is difficult to directly check the scratches 19*a* even when a magnified image is used in some cases. In this case, whether or not the scratches 19*a* exist may be determined based on the contrasting density of the captured image. In imaging the wafer 11 by the camera 92, when a region in which the scratches 19*a* have been formed is irradiated with light from the illuminators 94, irregular reflection of the light occurs in this region. As a result, in the captured image, a difference in the contrasting density is generated between the region in which the scratches 19*a* have been formed and the region in which the scratches 19*a* have not been formed. For example, in the case in which the scratches 19*a* with a depth of approximately 50 nm or smaller have been formed on the side of the back surface 11*b* of the wafer 11 composed of silicon, when the wafer 11 is imaged by the camera 92 (visible light camera) while irradiation with light (visible light) from the illuminators 94 is executed, a captured image in which the region in which the scratches 19*a* have been formed has white turbidity is obtained due to irregular reflection of the light. Then, the image processing section 98 determines whether or not the scratches 19*a* exist based on the difference in the contrasting density between the captured image input from the camera 92 and the image for reference stored in the storing section 100. For example, the image processing section 98 converts the difference in the contrasting density to a numerical value and determines that the scratches 19*a* exist when the numerical value exceeds a predetermined value (threshold). As above, the scratch determining unit 72 may determine whether or not the scratches 19*a* exist based on the difference in the contrasting density between the region in which the scratches 19*a* exist and the region in which the scratches 19*a* do not exist, generated in the captured image due to irregular reflection of light in the region in which the scratches 19*a* exist. Due to this, determination of whether or not the scratches 19*a* exist is enabled even when it is difficult to directly observe the shape of the scratches 19*a* from the image acquired by the camera 92.

Furthermore, the scratch determining unit 72 repeats the above-described procedure to thereby determine whether or not the scratches 19*a* exist regarding the whole of the side of the back surface 11*b* of the wafer 11. However, the scratch determining unit 72 may determine whether or not the scratches 19*a* exist regarding only part of the side of the back surface 11*b* of the wafer 11. For example, the time taken for the determination is shortened by determining whether or not the scratches 19*a* exist regarding only the side of the back surface 11*b* of the peripheral part of the wafer 11, in which the scratches 19*a* are formed less readily in particular (see FIG. 6A).

Moreover, when a region for which it has been determined that the scratches 19*a* do not exist by the scratch determining unit 72 is included in the wafer 11, the control unit 76 (see FIG. 1) causes the informing unit 78 to inform that a region in which the scratches 19*a* do not exist is included in the wafer 11. For example, when the informing unit 78 is a warning lamp, the control unit 76 causes the warning lamp to be lit with a predetermined color or pattern. Furthermore, when the informing unit 78 is a display, the control unit 76 causes the display to display warning information indicating that a region in which the scratches 19*a* do not exist is included in the wafer 11. Moreover, when the informing unit 78 is a speaker, the control unit 76 causes the speaker to transmit a warning sound or warning announcement indicating that a region in which the scratches 19*a* do not exist is included in the wafer 11. Due to the warning issued by the informing unit 78, that the scratches 19*a* have not been properly formed on the back surface 11*b* of the wafer 11 is easily recognized by the operator. Then, the processing condition of the polishing processing is adjusted and proper polishing processing is executed for the wafer 11 anew.

As described above, the processing apparatus 2 according to the present embodiment includes the scratch determining unit 72 that determines whether or not the scratches 19*a* exist on the side of the back surface 11*b* of the wafer 11 and the informing unit 78 that informs that a region in which the scratches 19*a* do not exist is included in the wafer 11 when a region for which it has been determined that the scratches 19*a* do not exist by the scratch determining unit 72 is included in the wafer 11. This allows the operator to easily and surely check whether or not the minute scratches 19*a* have been properly formed in the wafer 11 without executing work of visually checking the side of the back surface 11*b* of the wafer 11, or the like.

The frequency of the determination of whether or not the scratches 19*a* exist by the scratch determining unit 72 can be freely set. For example, the scratch determining unit 72 may execute the determination regarding all wafers 11 processed by the processing apparatus 2 or may execute the determination every predetermined number of wafers 11 regarding part of the wafers 11 processed by the processing apparatus 2.

Furthermore, in the present embodiment, the description is made about the case in which the processing apparatus 2 includes two sets of the grinding unit 32*a* and 32*b* and two kinds of grinding processing (coarse grinding processing and finishing grinding processing) can be executed. However, the number of sets of the grinding unit included in the processing apparatus 2 may be one. Moreover, in the present embodiment, the case in which the processing apparatus 2 includes the grinding units 32*a* and 32*b* and the polishing unit 60 is described. However, in the case of executing the grinding processing of the wafer 11 by a dedicated apparatus (grinding apparatus) separately prepared, the processing apparatus 2 does not need to include the grinding units 32*a* and 32*b*.

Besides, structures, methods, and so forth according to the above-described embodiment can be implemented with appropriate changes without departing from the range of the object of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A processing apparatus that polishes a back surface side of a wafer on which devices are formed on a front surface side, the processing apparatus comprising:

a chuck table that holds the wafer and rotates;

a polishing unit that forms scratches on the back surface side of the wafer while polishing the back surface side of the wafer by pressing a polishing pad containing abrasive grains against the back surface side of the wafer held by the chuck table while rotating the polishing pad;

a scratch determining unit that determines whether or not the scratches exist on the back surface side of the wafer polished by the polishing unit; and an informing unit that informs an operator when a region for which it has been determined that the scratches do not exist by the scratch determining unit is included in the wafer, and wherein:

the scratch determining unit includes a camera that images the wafer and obtains an image of the back surface side of the wafer, the scratch determining unit determines whether or not the scratches exist based on a difference in contrasting density of the image obtained by the camera between a region in which the scratches exist and a region in which the scratches do not exist, and the scratch determining unit includes an image processing section that converts the difference in contrasting density to a numerical value, and determines that the scratches exist when the numerical value exceeds a predetermined threshold.

2. The processing apparatus according to claim 1, wherein:

the scratch determining unit determines whether or not the scratches exist regarding a whole of the back surface side of the wafer.

3. The processing apparatus according to claim 1, further comprising:

a grinding unit that grinds the back surface side of the wafer held by the chuck table and thins the wafer to a predetermined thickness.

4. The processing apparatus according to claim 1, wherein the scratch determining unit is configured and arranged to detect scratches of a depth of 50 nm or smaller.

5. The processing apparatus according to claim 1, wherein the scratch determining unit is configured and arranged to detect scratches of a depth of about 50 nm.

6. A processing apparatus that polishes a back surface side of a wafer on which devices are formed on a front surface side, the processing apparatus comprising:

a chuck table that holds the wafer and rotates;

a polishing unit that forms scratches on the back surface side of the wafer while polishing the back surface side of the wafer by pressing a polishing pad containing abrasive grains against the back surface side of the wafer held by the chuck table while rotating the polishing pad;

a scratch determining unit that determines whether or not the scratches exist on the back surface side of the wafer polished by the polishing unit; and an informing unit that informs an operator when a region for which it has been determined that the scratches do not exist by the scratch determining unit is included in the wafer, and wherein the scratch determining unit includes a camera that images the wafer and obtains an image of the back surface side of the wafer, and the scratch determining unit determines whether or not the scratches exist based on a difference in contrasting density of the image obtained by the camera between a region in which the scratches exist and a region in which the scratches do not exist, wherein the scratch determining unit includes an image processing section that compares the image of the back surface side of the wafer captured by the camera with a reference image of a wafer without scratches, and determines whether or not scratches exist on the back surface side of the wafer polished by the polishing unit, and wherein the image processing section determines whether or not scratches exist on the back surface side of the wafer polished by the polishing unit based on the existence or lack of white turbidity in the captured image, where the white turbidity is the result of irregular reflection of light off of the scratches.

7. The processing apparatus according to claim 6, wherein the image processing section converts the difference in contrasting density to a numerical value, and determines that the scratches exist when the numerical value exceeds a predetermined threshold.

8. A processing apparatus that polishes a back surface side of a wafer on which devices are formed on a front surface side, the processing apparatus comprising:

a chuck table that holds the wafer and rotates;

a polishing unit that forms scratches on the back surface side of the wafer while polishing the back surface side of the wafer by pressing a polishing pad containing abrasive grains against the back surface side of the wafer held by the chuck table while rotating the polishing pad;

a scratch determining unit that determines whether or not the scratches exist on the back surface side of the wafer polished by the polishing unit; and an informing unit that informs an operator when a region for which it has been determined that the scratches do not exist by the scratch determining unit is included in the wafer, and wherein the scratch determining unit includes a camera that images the wafer and obtains an image of the back surface side of the wafer, and the scratch determining unit determines whether or not the scratches exist based on a difference in contrasting density of the image obtained by the camera between a region in which the scratches exist and a region in which the scratches do not exist, wherein the scratch determining unit includes an image processing section that compares the image of the back surface side of the wafer captured by the camera with a reference image of a wafer without scratches, and determines whether or not scratches exist on the back surface side of the wafer polished by the polishing unit, and wherein the image processing section converts the difference in contrasting density to a numerical value, and determines that the scratches exist when the numerical value exceeds a predetermined threshold.

* * * * *